US009068415B2

(12) United States Patent
Fraser

(10) Patent No.: US 9,068,415 B2
(45) Date of Patent: Jun. 30, 2015

(54) WIRELESS DRILL STRING DISCONNECT

(71) Applicant: Saudi Arabian Oil Company, Dhahran (SA)

(72) Inventor: David Scott Fraser, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 262 days.

(21) Appl. No.: 13/734,662

(22) Filed: Jan. 4, 2013

(65) Prior Publication Data

US 2013/0213640 A1 Aug. 22, 2013

Related U.S. Application Data

(60) Provisional application No. 61/582,879, filed on Jan. 4, 2012.

(51) Int. Cl.

| | |
|---|---|
| ***E21B 23/00*** | (2006.01) |
| ***E21B 47/12*** | (2012.01) |
| ***E21B 17/06*** | (2006.01) |

(52) U.S. Cl.

CPC ..... *E21B 23/00* (2013.01); *E21B 47/12* (2013.01); *E21B 17/06* (2013.01)

(58) Field of Classification Search

CPC ..... E21B 7/046; E21B 17/02; E21B 17/03; E21B 17/06

See application file for complete search history.

(56) References Cited

U.S. PATENT DOCUMENTS

| | | | |
|---|---|---|---|
| 2,824,718 | A | 2/1958 | Currie |
| 5,718,291 | A | 2/1998 | Lorgen et al. |
| 5,787,982 | A | 8/1998 | Bakke |
| 5,967,231 | A | 10/1999 | Laurel et al. |
| 6,186,249 | B1 | 2/2001 | Bjornstad |
| 6,269,883 | B1 | 8/2001 | Gissler et al. |

(Continued)

FOREIGN PATENT DOCUMENTS

| | | |
|---|---|---|
| FR | 2101091 | 8/1970 |
| FR | 2946998 A1 | 12/2010 |

OTHER PUBLICATIONS

J.E. Dendy Jr. et al., "Multigrid Methods for Three-Dimensional Petroleum Reservoir Simulation", Society of Petroleum Engineer, Feb. 6-8, 1989, pp. 19-25, Houston USA.

(Continued)

*Primary Examiner* — William P Neuder

(74) *Attorney, Agent, or Firm* — Bracewell & Giuliani LLP; Constance Gall Rhebergen

(57) ABSTRACT

A disconnector drill string has an uphole section and a downhole section coupled together by a disconnection sub, an operative length and an internal fluid conduit that extends along its operative length. The disconnection sub is operable to receive wirelessly a pre-designated command signal, to selectively couple the uphole section and the downhole section together, and to selectively uncouple the uphole section and the downhole section from one another. A method for using the disconnector drill string in a well bore includes the steps of introducing the disconnector drill string into the well bore, transmitting wirelessly the pre-designated command signal to the disconnection sub such that the disconnection sub selectively operates to uncouple the uphole section of the disconnector drill string from the downhole section of the disconnector drill string, and removing the uphole section of the disconnector drill string from the well bore.

20 Claims, 6 Drawing Sheets

(56) References Cited

U.S. PATENT DOCUMENTS

| | | | | |
|---|---|---|---|---|
| 7,349,833 | B2 | 3/2008 | Yu | |
| 7,637,330 | B2 | 12/2009 | Angman et al. | |
| 2004/0069496 | A1 | 4/2004 | Hosie et al. | |
| 2005/0022987 | A1 | 2/2005 | Green et al. | |
| 2007/0188344 | A1 * | 8/2007 | Hache et al. | 340/853.1 |
| 2008/0041597 | A1 | 2/2008 | Fisher et al. | |
| 2008/0173481 | A1 | 7/2008 | Menezes et al. | |
| 2011/0088903 | A1 | 4/2011 | Onadeko et al. | |
| 2011/0168389 | A1 | 7/2011 | Meijs et al. | |
| 2011/0191080 | A1 | 8/2011 | Klie | |
| 2011/0226482 | A1 | 9/2011 | Trewhella et al. | |

OTHER PUBLICATIONS

Klaus Stuben, "A Review of Algebraic Multigrid", (SCAI) (GMD), Nov. 9, 1999, pp. 1-36, St. Augustin Germany.

Yousef Saad, "Iterative Methods for Sparse Linear Systems", Society for Industrial and Applied Mathematics, (2000), pp. 1-460.

PCT International Search Report and the Written Opinion of the International Searching Authority dated Feb. 5, 2014; International Application No. PCT/US2013/020221; International File Date: Jan. 4, 2013.

* cited by examiner

WIRELESS DRILL STRING DISCONNECT

CROSS-REFERENCE TO RELATED PATENT APPLICATIONS

This application claims priority from U.S. Provisional Application No. 61/582,879, filed Jan. 4, 2012. For purposes of United States patent practice, this application incorporates the contents of the Provisional Application by reference in its entirety.

BACKGROUND OF THE INVENTION

1. Field of the Invention

The field of invention relates to a drill string device and method of use. More specifically, the field relates to disconnecting and reconnecting a drill string and method of use.

2. Description of the Related Art

In horizontal drilling, there are many challenges to maintaining operations in non-vertical or deviated systems. Gravity pulls the drill pipes, collars, bit and tools against the well bore wall, causing friction while drilling. In extended-reach wells (ERWs), well bore collapses, stress fracturing and breaking of long drill strings, poor fluid circulation along the length of the well bore and solids accumulation can trap a drill string. Halting the rotation of the drill string further exacerbates the friction problem.

When a drill string becomes stuck downhole, a few methods are employed before declaring the string lost. An in-line mechanical jar, hydraulic drilling jar or hydro-mechanical jar can provide an acute physical "shock" along the drill string axis. The force of the discharging jar suddenly shifts or pulls the drill string along the length of the well bore, dislodging it. Increasing drilling fluid circulation can provide fluid lift to the drill string and can erode solids that have blocked off drill string movement. "Pulsing" the drill string with rapid, successive rotational turns can shift obstructions and free the string.

Potentially a number of problems exist with simply increasing drilling fluid flow in a horizontal well, especially an ERW to treat a well bore condition. The fluid exiting the end of the drill string has traveled hundreds or thousands of meters—in some cases several kilometers—before passing into the well bore. To address the problem, the fluid then has to travel possibly thousands of more meters in the well bore annulus before encountering the well bore condition. Some ERWs have horizontal runs beyond 35,000 feet. This requires a tremendous amount of energy to reach this problem site, usually in the form of higher fluid pressure. Well bore conditions, including pore pressure and fracture gradient, can severely limit the maximum pressure of the drilling fluid passing from the drill pipe against the face of the distal end of the well bore.

If these simple operational techniques do not work, a wireline, coiled tubing or slick line crew can intervene and sever the drill string while in the hole. These teams often use specialized tools specifically manufactured for the job. Sometimes explosive are employed. The cost of such a recovery operations depends on many factors, including the physical location of the well bore (country; on or off-shore), local regulations, formation and well bore structure, transportation of personnel and equipment, government and corporate permission to execute the job; manufacturing time for specialty tools, and ancillary support operations, including fishing or well bore circumvention. Such intervention can run from a few hours to weeks of drilling and completions time, with idle work crews, delays in scheduled production of hydrocarbon fluid and the loss of expensive downhole tools, including the drill bit, hundreds if not thousands of feet of drill pipe, collars and the borehole assemblies (BHA). The total cost can reach into the millions of dollars per instance.

Disconnection tools have a long history in the petroleum drilling service industry. Several types have come to prominence over the years, including those having shear-release, pressure-release and electrically controlled mechanisms. Shear and pressure disconnectors activate by either a build-up in pressure caused by introducing a restriction inside the throat of the tool, for example, a ball, dart or plug, or by using a predefined overpull or drill string turn sequence that initiates a mechanical release. Electrical disconnectors use wires from the surface through the drill string or by wireline or coiled tube. All of these disconnectors are "one-use": once they disconnect two sections of drill string they cannot be recombined.

Disconnect tools have several inherent problems related to horizontal, ERW, multilateral and multi-tier well bore drilling. Conventional methods of freeing at least a portion of a stuck drill string are less appropriate in long-reaching horizontal well bores and in multi-lateral wells. In horizontal wells, the main problems are friction and gravity over the long horizontal leg. The designs of many tools are for operation in vertical environments and only over short distances—a few thousand feet. Many tools and techniques requiring wireline or coiled tubing access to disconnect or sever the drill string. These tools are problematic due to both the direction of gravity versus the direction of the well bore (that is, pulling the tube to the bottom of the well bore) and friction against the well bore wall (requiring much more force to drive the intervening tool). In multilateral and multi-tier well bores, these tools and methods are very difficult if not impossible to use.

SUMMARY OF THE INVENTION

A disconnector drill string has an uphole section and a downhole section coupled together by a disconnection sub. The disconnector drill string has an operative length and an internal fluid conduit that extends along its operative length. The uphole section is positioned uphole of the downhole section along the operative length of the disconnector drill string. The disconnection sub is operable to receive wirelessly a pre-designated command signal. The disconnection sub is also operable to selectively couple the uphole section and the downhole section together. The disconnection sub is also operable to selectively uncouple the uphole section and the downhole section from one another. An embodiment of the disconnector drill string includes a borehole assembly (BHA) as part of the downhole section. The BHA is operable when it couples to the uphole section and is not operable when it does not couple to the uphole section.

A method for using the disconnector drill string in a well bore includes the step of introducing the disconnector drill string into the well bore. The well bore is defined by a well bore wall extending from the surface into a hydrocarbon-bearing formation and contains a well bore fluid. The method of use also includes the step of transmitting wirelessly the pre-designated command signal to the disconnection sub such that the disconnection sub selectively operates to uncouple the uphole section of the disconnector drill string from the downhole section of the disconnector drill string. When this occurs, the internal fluid conduit of the disconnector drill string is severed. The method of use also includes the step of removing the uphole section of the disconnector drill string from the well bore. Upon removal of the uphole section, the disconnected downhole section of the disconnector drill string remains in the well bore.

An embodiment of the method includes the step of introducing a second uphole section into the well bore. The second uphole section has a disconnection sub. A further embodiment of the method includes the step of wirelessly transmitting a pre-designated command signal to the disconnection sub to selectively couple the second uphole section to the downhole section. Upon coupling the second uphole section and the downhole section, a second disconnector drill string forms having an internal fluid conduit along its operative length. A further embodiment of the method includes the step of operating the second disconnector drill string to extend the length of the horizontal length of the well bore. A further embodiment of the method includes the step of removing the second disconnector drill string from the well bore.

An embodiment of the method includes the step of introducing a second uphole section into the well bore. The second uphole section includes downhole tool, a first disconnection sub and a second disconnection sub. A further embodiment of the method includes the steps of transmitting a pre-designated command signal to the first disconnection sub to couple the second uphole section to the downhole section and transmitting a pre-designated command signal to the second disconnection sub to uncouple the second uphole section from the downhole section. The combination of transmissions results in coupling the downhole tool to the downhole section.

The segmented and modular nature of pipe, collars and tools allows configuration of the disconnector drill string to support other well bore maintenance activities. The disconnector drill string can provide support for installing casing, cementing operations, water jetting, circulating drilling mud and other fluids, injecting acid or enzymes into the well bore for mud cake treatment, data collection and fishing for broken or abandoned equipment in the well bore. The variety of tasks possible with the disconnector drill string is only limited by the time required to round-trip the disconnector drill string, including reconfiguration time; the tools available; the needs of operations and the imagination of those skilled in the art.

Coupling together separate drill string sections is useful for performing several types of well bore activities, including fishing, swapping tools, and extending the reach of a drill string in horizontal, ERWs, multilateral, and multi-tier wells. The ability to easily disconnect and connect downhole portions of the drill string from uphole sections of the drill string expands operational flexibility. Temporary abandonment and recovery of the heavy, expensive and sometimes fragile assemblies and tools during horizontal, ERW, multilateral and multi-tier operation saves both time and money, and thereby improves operational reliability. Disconnecting easily and cleanly from a trapped or stuck section of drill string provides additional options for handling lost equipment and troubled well bores versus harsh and permanent disconnection.

Locating disconnection subs downstring from a heavy drill string section permits active position management of the heavy components of a drill string. Uncoupling and removing the heavy portion of the drill string (that is, drill collars and HWDP) before those portions of the drill string enter the horizontal run of the well bore can reduce overall drill string friction. Round tripping the uphole section allows for reconfiguration of the string with lighter components that are to enter the horizontal run. Such reconfiguration and readjustments of the weighted portions of the drill string helps with running tools such as sand control screens, slotted liners and in performing complex completion operations where the drill string should not rotate.

In instances where reconfiguration of the uphole section of the disconnector drill string supports additional drilling distance, including ERWs, the coupling of a modified uphole section to the downhole section of the disconnector drill string forms a new drill string that is longer in reach than the original disconnector drill string.

The coupling of the uphole section to the previously abandoned downhole section of drill string can render the equipment on the previously abandoned section operable. In such instances where the abandoned section of drill string includes a borehole assembly, establishing new control and power connections for the BHA provides the necessary means for freeing the drill string from the obstructions in the well bore holding it in place. This can prevent one of the most expensive components in the drill string—the BHA—from being lost.

"Book-ending" a downhole tool with disconnection subs can render the tool attachable to other objects, including immobile object, in the well bore. Examples of potentially immobile well bore objects include previously abandoned portion of drill string and broken BHAs. Tools like whipstocks, which are channeled wedges typically made of metal, once secured in the well bore can expedite circumvention drilling around an obstruction that would otherwise require remediation. Disconnection subs can connect to the immobile object and disconnect from the delivering drill string.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

In the accompanying Figures, similar components or features, or both, may have the same or similar reference label. FIGS. 1-3 are general schematics of several embodiments of the disconnector drill string and their methods of use. FIGS. 1-3 and their description facilitate a better understanding of the disconnector drill string and its methods of use. In no way should the Figures limit or define the scope of the invention.

DETAILED DESCRIPTION OF THE PREFERRED EMBODIMENTS

Figure 1:
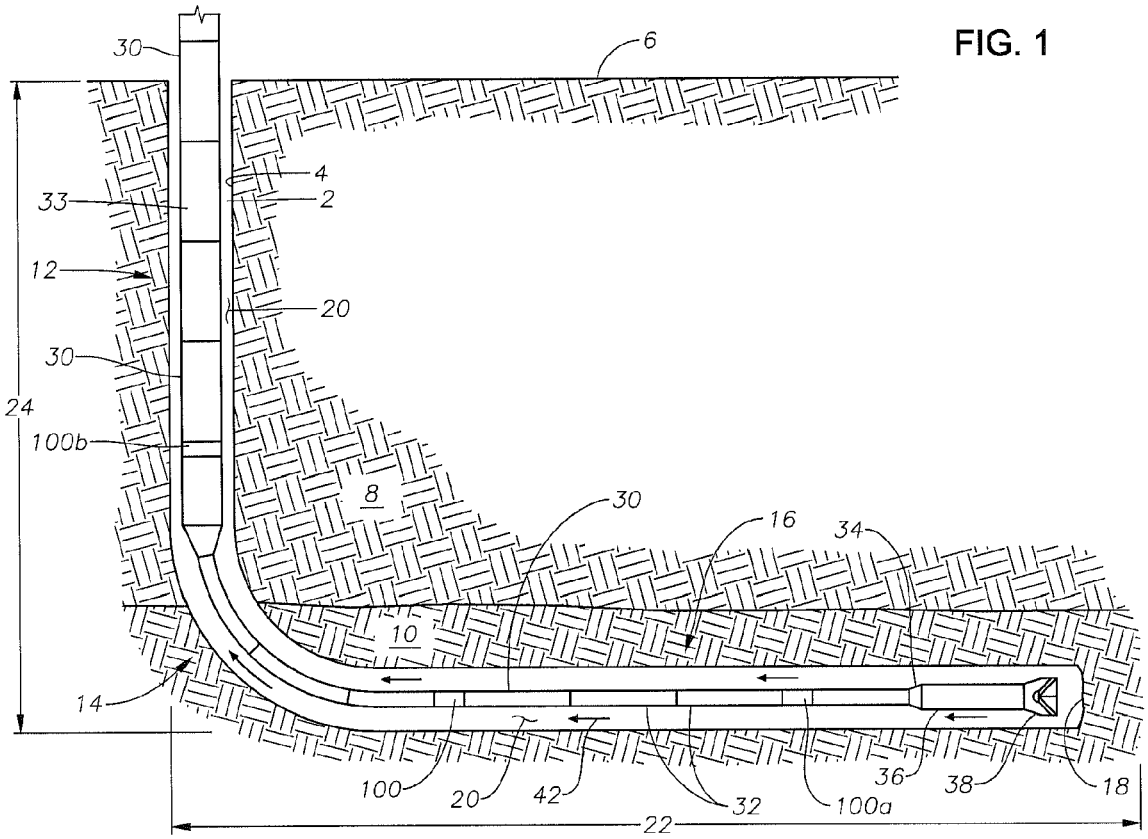
FIG. 1 is a general schematic of an embodiment of the disconnector drill string in a horizontal well bore.

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur.

Spatial terms describe the relative position of an object or a group of objects relative to another object or group of objects. The spatial relationships apply along vertical and horizontal axes. Orientation and relational words including "uphole" and "downhole"; "above" and "below"; "up" and "down" and other like terms are for descriptive convenience and are not limiting unless otherwise indicated.

Where a range of values is provided in the Specification or in the appended Claims, it is understood that the interval encompasses each intervening value between the upper limit and the lower limit as well as the upper limit and the lower limit. The invention encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

The "inclination angle" of a well bore is the measure of deviation in angle from true vertical from the perspective of traversing downward through the well bore from the surface. An angle of 0° degree downward is "true vertical". An angle of 90° from true vertical is "true horizontal". A "horizontal run", "leg", or "section" is a portion of the well bore where the inclination angle of the well bore is equal to or greater than 65° from true vertical, including values above true horizontal up to 115° from true vertical. A "horizontal well" is a well that has a well bore with a horizontal run for a portion of the well bore length. Horizontal wells have other portions of the well bore that are less than 65° in angle, including the vertical run that connects the well bore with the surface through the surface entry point.

The "well bore length" is the length of the fluid flow pathway, representing the long dimension of the well bore versus its diameter or width, internal to the well bore from the surface entry point to the face of the well bore. An "extended reach well" (ERW) is defined as a horizontal well having a well bore length along the horizontal run at least twice as long as the true vertical depth (TVD) of the well bore.

"Tripping" describes the act of moving the drill string or segments of the drill string into and out of the well bore. "Tripping in" refers to introducing the drill string into the well bore. "Tripping out" refers to removing the drill string from the well bore. "Round tripping" refers to removing the drill string from the well bore and then reintroducing the drill string into the well bore after a short interval of time. Modification to the drill string through the addition or subtraction of a tool or specialized equipment usually occurs when a drill string is being round-tripped.

FIG. 1

FIG. 1 shows well bore 2 as a space defined by well bore wall 4. Well bore 2 is a fluid pathway that extends from surface 6, through non-hydrocarbon bearing formation 8 into hydrocarbon-bearing formation 10. Well bore 2 has several sections, including vertical run 12, transition zone 14 and horizontal run 16. Horizontal run 16 extends in a generally horizontal direction from transition zone 14 until reaching the distal end of well bore 2, which is well bore face 18. Well bore 2 contains well bore fluid 20. Well bore 2 has horizontal run length 22 that is much longer than its total vertical depth (TVD) 24. Both horizontal run length 22 and TVD 24 are useful for determining the operative length of well bore 2.

FIG. 1 also shows disconnector drill string 30 previously introduced into well bore 2. Disconnector drill string 30 mainly comprises Drill pipes 32 and drill collars 33 couple to form the majority of disconnector drill string 30. Disconnector drill string 30 also includes borehole assembly (BHA) connector 34, BHA 36 and drill bit 38 proximate to well bore face 18. Connectors are also referred to as "subs" because they are much shorter than drill pipe and drill collars. BHA 36 can contain downhole motors, rotary steerable systems, jars, stabilizers, measurement while drilling (MWD) and logging while drilling (LWD) tools and sensors.

Disconnector drill string 30 has an internal fluid conduit (not shown) that permits fluid communication between surface 6 and well bore 2. The internal fluid conduit of disconnector drill string 30 is accessible at drill bit 38. The exterior surface of disconnector drill string 30 and well bore wall 4 define well bore annulus 40. Well bore fluid 20 circulates (represented by arrows 42) within well bore 2 through the interior fluid conduit (not shown) of disconnector drill string 30 and well bore annulus 40.

Although not shown in detail, disconnector drill string 30 couples to a wireless telemetry system. An operator monitoring system is in two-way signal communication with disconnector drill string 30 through the wireless telemetry system. Based upon its configuration, the operator monitoring system receives downhole condition data through the wireless telemetry system for human or computer interpretation, including conversion into borehole condition data. The wireless telemetry system provides the communication interface for receiving downhole condition information and transmitting predesignated command signals to tools and equipment in well bore 2, including those on BHA 36 and along the operative length of disconnector drill string 30.

FIG. 1 also shows disconnector drill string 30 including disconnection sub 100 along its operative length. Disconnection sub 100 can have various physical configurations, including disconnection sub 100*a* for fitting two drill pipes 32 together and disconnection sub 100*b* for fitting between two drill collars 33.

FIG. 2

Where a drill string becomes immobile or stuck in the well bore, a disconnection sub can enhance the ability to free a portion of the drill string, reconfigure it and then attempt to free and extract the trapped portion from the well bore.

Figure 2A:
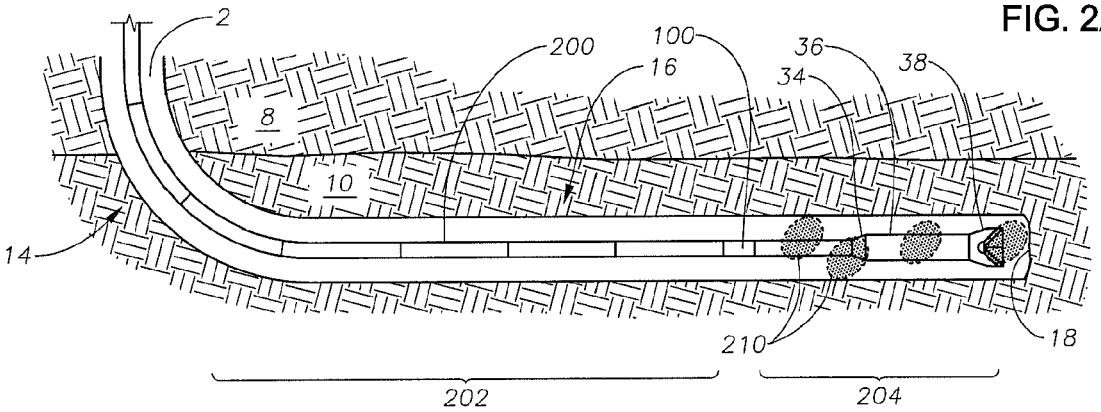
FIGS. 2A-F are general schematics of a portion of an embodiment of the disconnector drill string in a portion of a horizontal well bore showing several steps in freeing an immobilized disconnector drill string.

FIG. 2A shows disconnector drill string 200 in well bore 2. Disconnector drill string 200 has disconnection sub 100 coupling uphole section 202 to downhole section 204. Debris 210 immobilizes disconnector drill string 200. Debris 210 is downhole of disconnection sub 100.

Figure 2B:
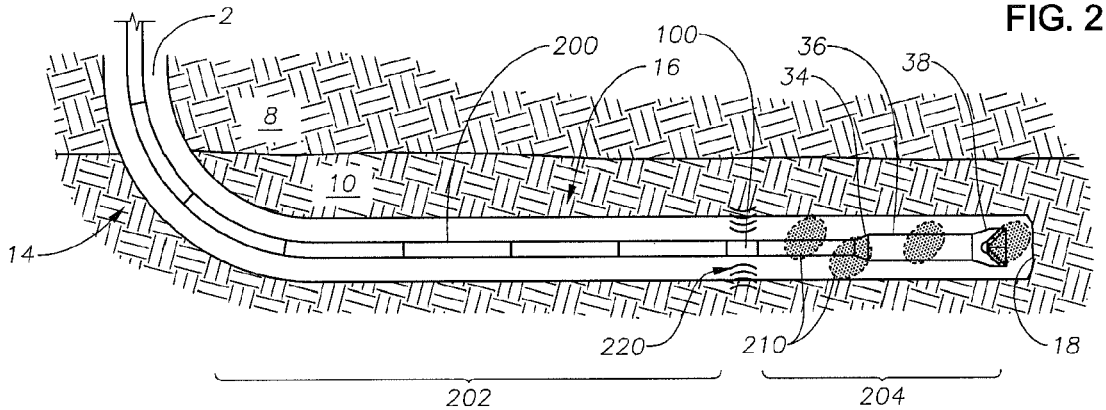

FIG. 2B shows disconnection sub 100 receiving a transmitted wireless pre-designated command signal (represented by inbound ellipses 220) from the surface (not shown). The wireless pre-designated command signal includes instructions for disconnection sub 100 to uncouple disconnector drill string 200. Disconnection sub 100, in response, uncouples uphole section 202 from downhole section 204 upon receipt of the pre-designated command signal.

Figure 2C:
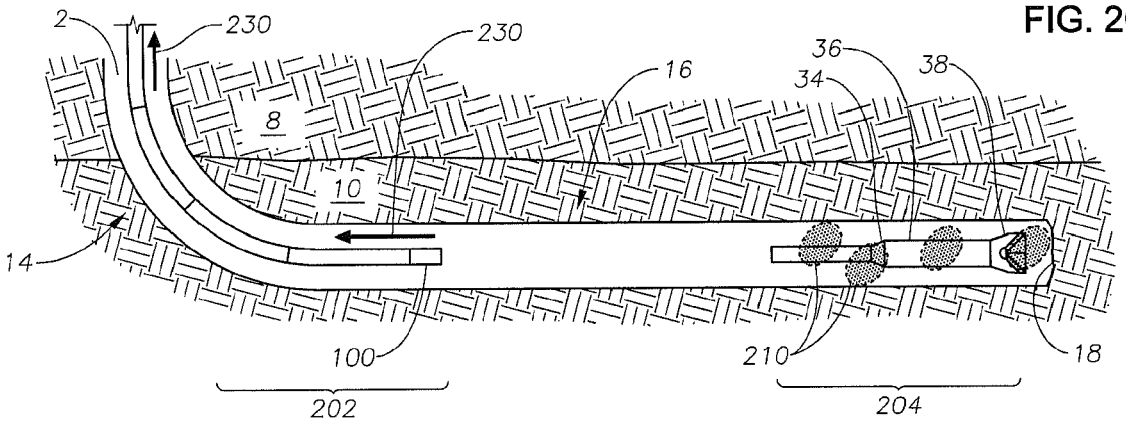

FIG. 2C shows uphole section 202 of disconnector drill string 200 tripping out (arrow 230) of well bore 2. Downhole section 204, which includes BHA 36, remains in well bore 2, abandoned and inoperable.

Figure 2D:
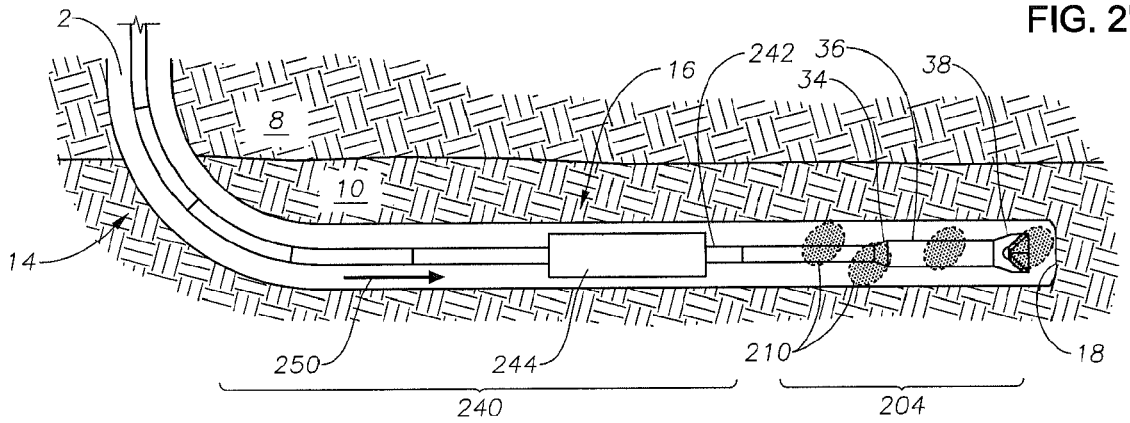

FIG. 2D shows the introduction (arrow 250) of second uphole section 240, which includes second disconnection sub 242 and motor 244, into well bore 2. The introduction positions second disconnection sub 242 proximate to downhole section such that second disconnection sub 242 is operable to couple second uphole section 240 and downhole section 204.

Figure 2E:
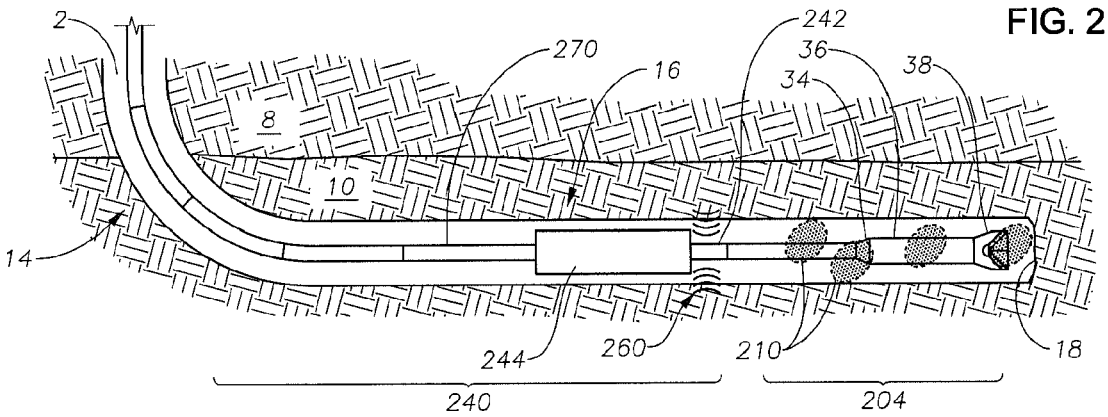

FIG. 2E shows second disconnection sub 242 receiving (inbound ellipses 260) a wireless pre-designated command signal transmitted from the surface. The pre-designated command signal instructs second disconnection sub 242 to couple second uphole section 240 to downhole section 204 in well bore 2.

The coupling of the two sections forms second disconnector drill string 270 with an internal fluid conduit along its operative length (not shown). Motor 244 is operable to provide power to drill bit 38 and BHA 36 upon coupling downhole section 204 to second uphole section 240 and introduction of fluid through the internal fluid conduit.

Figure 2F:
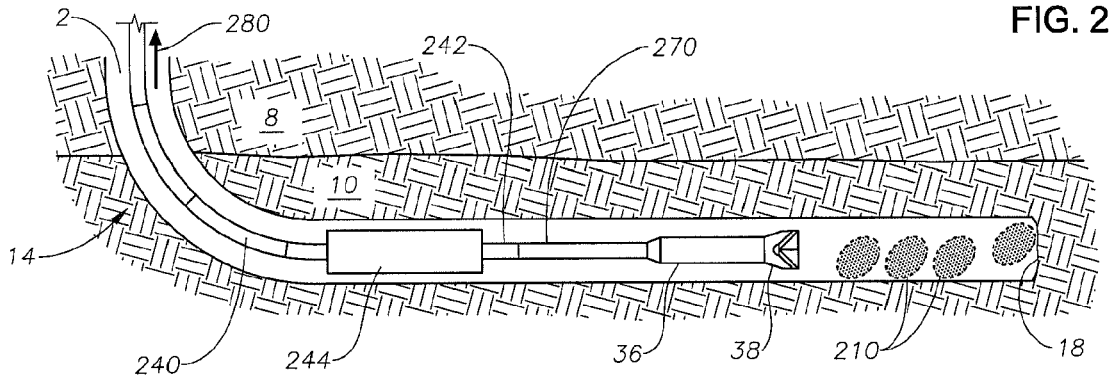

FIG. 2F shows second disconnector drill string 270 tripping out (arrow 280) from well bore 2 having its downhole section 204 freed from debris 210.

FIG. 3

Figure 3A:
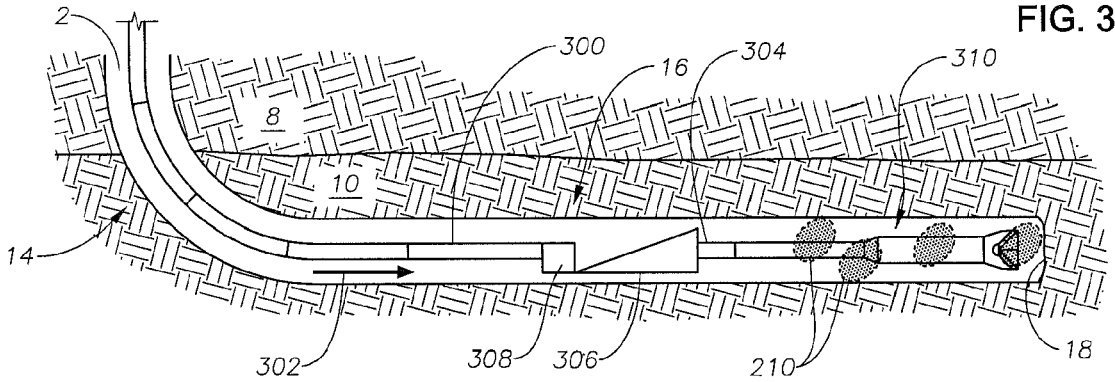
FIGS. 3A-C are general schematics of a portion of an embodiment of the disconnector drill string in a portion of a horizontal well showing several steps in securing a well bore tool to an immobilized object in a well bore.
Figure 3B:
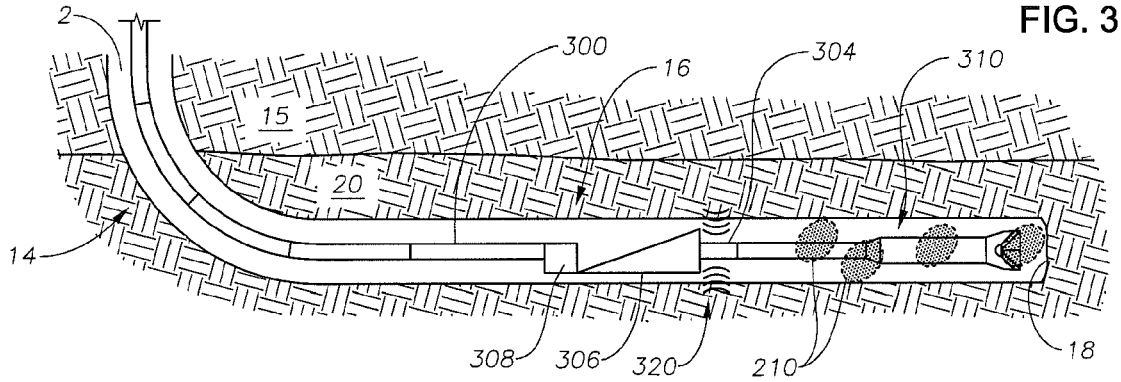
Figure 3C:
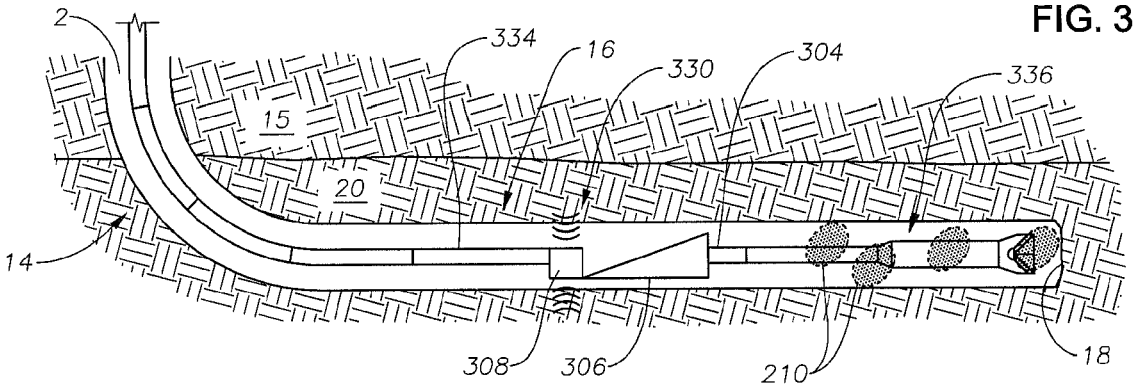

Instead of introducing a second uphole section with a motor for recovering the downhole section, abandoning the trapped downhole section and drill around is also an option. FIGS. 3A-C show part of a method of securing a well bore tool to an immobilized object in the well bore.

FIG. 3A shows immobilized downhole section 310 in well bore 2. Disconnector drill string with well bore tool 300 introduces (arrow 302) well bore tool 306 into well bore 2, which couples to first disconnection sub 304 and second disconnection sub 308. The introduction of disconnector drill string with well bore tool 300 is such that first disconnection sub 304 is operable to couple well bore tool 306 to immobilized downhole section 310.

FIG. 3B shows first disconnection sub 304 receiving (inbound ellipses 320) a transmitted wireless pre-designated command signal from the surface that contains instructions to couple disconnector drill string with well bore tool 300 to immobilized downhole section 310 using first disconnection sub 304.

FIG. 3C shows second disconnection sub 308 receiving (inbound ellipses 330) a transmitted wireless pre-designated command signal from the surface that contains instructions to uncouple disconnector drill string with well bore tool 300 from immobilized downhole section 310. Well bore tool 306 affixes to immobilized downhole section 310. The combination of coupling and uncoupling steps forms an immobilized downhole section with well bore tool 336 and disconnector drill string 334. Disconnector drill string 334 can trip out of well bore 2, leaving well bore tool 306 in position for later use.

Surface Control and Wireless Telemetry

A surface monitoring and control system acts as an interface between the operator and a sub that is operable to receive pre-designated command signals. The surface monitoring and control system acts as the interface for the operator to designate actions for the subs to take in the form of command signals. The surface system converts operator instructions into pre-designated commands for the subs to perform.

The surface monitoring system passes the pre-designated command to a wireless telemetry system for transmission into the well bore. The wireless telemetry system converts the pre-designated command into a wireless pre-designated command signal and transmits the pre-designed command signal into the well bore such that the disconnection sub receives and acts upon the instructions.

The surface monitoring and control system is in two-way data communications with the wireless telemetry system. The wireless telemetry system operates to receive the pre-designated command from the surface monitoring and control system, convert the pre-designated command into a pre-designated command signal, modulate the command signal for the intended recipient device and transmit wirelessly the pre-designated command signal downhole.

The two systems work in the other way upon receiving a signal from a device downhole. The wireless telemetry controller is operable to receive a data or status signal conveyed from the sub downhole, convert the signal into data and pass the data to the surface monitoring and control system for automated or manual processing. The surface monitoring and control system, in turn, displays information related to received downhole conditions and calculated borehole conditions into human-interpretable information for the operator.

Several known wireless telemetry techniques are useful for transmitting signals wirelessly between the surface and the disconnection sub, including electromagnetic (EM) telemetry and acoustic telemetry, especially solid acoustic telemetry.

Different wireless telemetry systems used in coordination with one another are useful as transmission methods for conveying wireless data, status and pre-designated command signals uphole and downhole. For example, an acoustic telemetry system can transmit a pre-designated command signal from the surface into the well bore while an EM telemetry system transmits a second, parallel signal downhole. In another example, a wireless telemetry system can transmit a pre-designated command signal via solid acoustic telemetry downhole while a sub transmits a data or status signal uphole using EM telemetry.

Disconnector Drill String

The disconnector drill string includes at least one disconnection sub.

The disconnection sub of the disconnector drill string is operable to receive a wireless pre-designated command signal. Upon receiving the wireless pre-designated command signal, the receiving sub correlates the instructions contained in the pre-designated command signal with an associated function. The sub operates to perform the necessary steps to execute the associated function.

The number and type of operations performed upon receipt of a pre-designed command signal are only limited by the capabilities of the sub and the instructions received. For example, a transmitted pre-designated command signal can instruct one or more subs to enter a non-dormant or "operational readiness" state; another pre-designed command signal can instruct a sub to power down. A pre-designed command signal can request operational status information from one or more subs or to convey back uphole previously collected data.

The pre-designated command signal can instruct more than one sub that normally operate independently of one another to act in concert in executing later-transmitted pre-designed command signals.

In instances where a device transmits a pre-designated command signal as a modulated, compressed or encoded signal, the receiving device is operable to demodulate, decompress or decode the wireless signal.

The disconnection sub can be located anywhere along the operative length of the disconnector drill string. The location of a disconnection sub can be between segments of drill pipes, collars and tools of similar or different gauge or type. The disconnector drill string can include multiple disconnection subs.

Disconnection Sub

The disconnector drill string has a disconnection sub that is operable to selectively decouple an uphole portion of the drill string from the downhole portion of the drill string. Optionally, the disconnector drill string is operable to selective couple the uphole portion of a drill string to the downhole portion of a drill string, forming a disconnector drill string.

An embodiment includes a disconnector drill string having more than one disconnection sub located along the operative length of the disconnector drill string. Each disconnection sub couples and decouples uphole and downhole sections relative to each disconnector while the disconnector drill string is in the well bore.

The disconnection sub while coupling an uphole and downhole section together efficiently transfers rotational energy as an integral part of the drill string as well as conveys fluid through the disconnector drill string internal fluid conduit.

The disconnection sub is operable to decouple an uphole section from a downhole section of drill string upon receipt of a pre-designated command signal associated with disconnection. Decoupling the disconnector drill string breaks the internal fluid conduit at the point of disconnection. Downhole equipment and tools, including the BHA, are inoperable without electrical, hydraulic or mud fluid flow from the surface. The unconnected downhole section is unable to function and cannot be removed from the well bore without mechanical assistance. The uphole section remains connected to the surface and is operable for removal and operation.

Optionally, the disconnection sub is operable to couple an uphole section of the drill string with the downhole section of the drill string upon receipt of a pre-designated command signal associated with connection. Coupling the uphole section of drill string with the downhole section of drill string forms a new disconnector drill string with an internal fluid conduit along the operative length of the formed drill string. Downhole equipment and tools, including the BHA, are enabled and operable with electrical, hydraulic or mud fluid flow from the surface upon coupling.

An embodiment of the disconnector drill string includes a disconnection sub that affixes to the uphole section of the disconnector drill string. The disconnection sub affixes to a section of the disconnection sub through known connection means, including threaded, frictional, flange, latch or adhesive connection. Upon decoupling the uphole section from the downhole section, the disconnection sub remains with the uphole section. An embodiment of the disconnector drill string includes a disconnection sub affixed to the downhole section of the disconnector drill string. Upon decoupling, such a disconnection sub attached to the downhole section of the disconnector drill string loses power and control from the surface. An embodiment of the disconnector drill string includes a disconnection sub where a first portion of the disconnection sub affixes to the uphole section and a second portion affixes to the downhole section. Such a configuration is preferable for a matching or "key-lock" configuration to ensure proper orientation of the uphole and downhole sections upon coupling, where the first portion and the second portion couple together to form the coupling between the uphole section and the downhole section.

Method of Using a Disconnector Drill String

The disconnector drill string, which includes a disconnection sub, is useful for temporarily abandoning a portion of the drill string in the well bore and later reconnecting to the previously abandoned section for continued operations or recovery. The disconnector drill string includes an uphole section, which is the portion of the disconnector drill string uphole of the disconnection sub, and the downhole section, which is the portion downhole of the disconnection sub.

The method includes introducing the disconnector drill string into a pre-formed well bore. The well bore wall defines the well bore and extends from the surface into the hydrocarbon-bearing formation. Well bore fluid fills the well bore. The introduction of the disconnector drill string forms a well bore annulus between the exterior of the disconnector drill string and the well bore wall.

The method includes transmitting wirelessly a pre-designated command signal directed to a disconnection sub positioned in the well bore along the operative length of the disconnector drill string. An embodiment of the method includes transmitting the pre-designated command signal in response to a detected downhole condition. The surface wireless telemetry system transmits the pre-designated command signal wirelessly such that the wireless signal reaches the disconnection sub downhole.

Upon receiving the pre-designated command signal, the disconnection sub selectively operates to uncouple the uphole section from the downhole section. The uphole section of remains connected with the surface; the downhole section of the drill string does not. Separating the uphole section from the downhole section of the disconnector drill string severs the internal fluid conduit of the disconnector drill string. Decoupling the disconnector drill string renders downhole equipment and tools, including BHAs, inoperable. Downhole instruments and tools require some form of power and instruction from the surface to operate.

The method includes tripping the uphole section of the drill string out of the well bore. Removing the uphole section from the downhole section abandons the downhole section in the well bore. The abandonment can be temporary or permanent.

An embodiment of the method includes introducing a second uphole section of a disconnector drill string into the well bore such that the leading element (that is, the downhole end) of the second uphole section is proximate to the downhole section. The second uphole section tripped in can have a similar or different configuration than the uphole section tripped out of the well bore. In an embodiment of the method, the second uphole section also includes a fishing tool. In an embodiment of the method, the second uphole section includes a hydraulic motor. In an embodiment of the method, the second uphole section includes a well bore bypass tool. In an embodiment of the method, the second uphole section has a longer operable length than the uphole section tripped out. In an embodiment of the method, the second uphole section has a fewer number of drill collars at the same operable length than the uphole section tripped out.

An embodiment of the method includes transmitting a second pre-designated command signal to the disconnection sub of the second uphole section such that second uphole section and the downhole section couple and form a second disconnector drill string. Coupling two separate drill string sections forms a new, second disconnector drill string. In an embodiment of the method, the second disconnector drill string has an internal fluid conduit along the length of the second disconnector drill string between the surface and the distal end of the downhole section. In an embodiment of the method, the coupling of the second uphole section and the downhole section renders equipment on the downhole section operable. The BHA, upon re-establishing power and control with the surface, is operable to perform activities that require mudflow, including directing fluids, taking measurements and rotating the drill bit. The second disconnector drill string is operable to continue drilling operations as a fully functional drill string.

An embodiment of the method includes introducing a fluid into the well bore through the internal fluid conduit of the second disconnector drill string. An embodiment of the method includes operating the second disconnector drill string such that the well bore debris in the well bore annulus releases it. An embodiment of the method includes operating the second disconnector drill string such that it extends the horizontal length of the well bore. An embodiment of the method includes tripping out the second disconnector drill string. The recovery of the second disconnector drill string occurs upon re-establishing fluid flow and functionality to the previously disconnected downhole section.

An embodiment of the method includes introducing a second uphole section of a disconnector drill string into the well bore where that the leading element of the second uphole section is proximate to the downhole section. In such a method, the leading element is a first disconnection sub. A downhole tool couples to the first disconnection sub and a second disconnection sub couples to the downhole tool uphole. In an embodiment of the method, transmitting a pre-designated command signal to the first disconnection sub of the second uphole section couples the second uphole section and the downhole section of the disconnector drill string. In an embodiment of the method, a fluid conduit forms along the length of the formed drill string. In an embodiment of the method, transmitting a pre-designated command signal to the second disconnection sub of the second uphole section decouples the downhole tool from the second uphole section, forming both a second uphole section without the downhole tool and a downhole section coupled with the downhole tool. The first disconnection sub secures the downhole tool to the downhole section. An embodiment of the method includes tripping out the second uphole section without the downhole tool. The downhole tool can be a well bore diversion tool, including a whipstock.

What is claimed is:

1. A method for using a disconnector drill string in a well bore comprising the steps of:

introducing the disconnector drill string into the well bore, where the disconnector drill string has a disconnection sub, an internal fluid conduit, an operative length, first uphole section and a downhole section that are coupled together by the disconnection sub, the first uphole section positioned uphole of the downhole section along the operative length of the disconnector drill string, and where the well bore is defined by a well bore wall extending from the surface into a hydrocarbon-bearing formation and contains a well bore fluid;

transmitting wirelessly a pre-designated command signal to the disconnection sub such that the disconnection sub selectively operates to uncouple the first uphole section of the disconnector drill string from the downhole section of the disconnector drill string, severing the internal fluid conduit of the disconnector drill string; and removing the first uphole section of the disconnector drill string from the well bore such that the downhole section of the disconnector drill string remains in the well bore; and introducing a second uphole section into the well bore, where the second uphole section has a disconnection sub on a distal end of the second uphole section, such that the disconnection sub is positioned proximate to the downhole section.

2. The method of claim 1 where the well bore is a horizontal well bore.

3. The method of claim 1 where the downhole section of the disconnector drill string further comprises a borehole assembly, where the borehole assembly is operable while coupled to the first uphole section.

4. The method of claim 1 where the pre-designated command signal is transmitted using either solid acoustic telemetry or electromagnetic telemetry.

5. The method of claim 1 where the disconnection sub is located in a non-horizontal section of the well bore at the time of transmission of the pre-designated command signal.

6. The method of claim 1, where the second uphole section has a different configuration than the removed first uphole section.

7. The method of claim 1, where the second uphole section includes a hydraulic motor.

8. The method of claim 1, further comprising the step of transmitting wirelessly a second pre-designated command signal to the disconnection sub such that the disconnection sub selectively operates to couple the second uphole section to the downhole section, forming a second disconnector drill string, where the second disconnector drill string has an internal fluid conduit.

9. The method of claim 8 where the downhole section of the second disconnector drill string further comprises a borehole assembly, where the borehole assembly is operable while coupled to the second uphole section.

10. The method of claim 8 further comprising the step of introducing a fluid into the well bore through the internal fluid conduit of the second disconnector drill string.

11. The method of claim 8 further comprising the step of operating the second disconnector drill string to clear debris from a well bore annulus, where the well bore annulus is defined as the space between an external surface of the second disconnector drill string and the well bore wall.

12. The method of claim 8 comprising the step of operating the second disconnector drill string to extend the horizontal length of the well bore.

13. The method of claim 8 further comprising the step of removing the second disconnector drill string from the well bore.

14. The method of claim 1, where the second uphole section comprises a first disconnection sub, a second disconnection sub and a downhole tool, where the first disconnection sub and the second disconnection sub couple to opposing ends of the downhole tool and the first disconnection sub is the disconnection sub on the distal end of the second uphole section.

15. The method of claim 14 further comprising the steps of:

transmitting wirelessly a second pre-designated command signal to the first disconnection sub such that the disconnection sub selectively operates to couple the second uphole section to the downhole section, and transmitting wirelessly a third pre-designated command signal to the second disconnection sub such that the second disconnection sub selectively operates to uncouple the second uphole section from the downhole section, such that the downhole tool couples to the downhole section and does not couple to the second uphole section.

16. The method of claim 15 where the downhole tool is a well bore diversion tool.

17. A disconnector drill string in a well comprising:

a first uphole section;

a downhole section coupled together by a disconnection sub, where the disconnector drill string has an operative length and an internal fluid conduit that extends along its operative length, where the first uphole section is positioned uphole of the downhole section along the operative length, and where the disconnection sub is operable to receive wirelessly a pre-designated command signal, to selectively couple the first uphole section and the downhole section together, and to selectively uncouple the first uphole section and the downhole section from one another so that the first uphole section can be removed from the well while the downhole section remains in the well; and a second uphole section with a second disconnection sub, the second uphole section for insertion into the well after removal of the uphole section from the well.

18. The disconnector drill string of claim 17 where the downhole section of the disconnector drill string further comprises a borehole assembly, where the borehole assembly is operable while coupled to the first uphole section of the disconnector drill string.

19. The disconnector drill string of claim 17 where the disconnection sub is affixed to the first uphole section of the disconnector drill string.

20. The disconnector drill string of claim 17 where the disconnector drill string is operable to receive the pre-designated command signal using solid acoustic telemetry.

* * * * *